US010519979B2

(12) United States Patent
Lin et al.

(10) Patent No.: US 10,519,979 B2
(45) Date of Patent: Dec. 31, 2019

(54) CENTRIFUGAL FAN

(71) Applicant: ASUSTek COMPUTER INC., Taipei (TW)

(72) Inventors: Hsin-Chen Lin, Taipei (TW); Ing-Jer Chiou, Taipei (TW)

(73) Assignee: ASUSTEK COMPUTER INC., Taipei (TW)

( * ) Notice: Subject to any disclaimer, the term of this patent is extended or adjusted under 35 U.S.C. 154(b) by 90 days.

(21) Appl. No.: 15/851,287

(22) Filed: Dec. 21, 2017

(65) Prior Publication Data

US 2018/0187699 A1 Jul. 5, 2018

(30) Foreign Application Priority Data

Dec. 30, 2016 (CN) ..... 2016 2 1479856 U

(51) Int. Cl.

| | |
|---|---|
| ***F04D 29/28*** | (2006.01) |
| ***F04D 29/66*** | (2006.01) |
| *F04D 29/30* | (2006.01) |
| *F04D 29/32* | (2006.01) |
| *F04D 29/38* | (2006.01) |

(52) U.S. Cl.

CPC ..... *F04D 29/666* (2013.01); *F04D 29/281* (2013.01); *F04D 29/282* (2013.01); *F04D 29/30* (2013.01); *F04D 29/328* (2013.01); *F04D 29/384* (2013.01)

(58) Field of Classification Search

CPC .... F04D 29/281; F04D 29/282; F04D 29/666; F04D 29/667; F04D 29/30; F04D 29/305; F04D 29/328

USPC ..... 416/175, 203, 182, 183, 185, 189

See application file for complete search history.

(56) References Cited

U.S. PATENT DOCUMENTS

| | | | | | |
|---|---|---|---|---|---|
| 1,534,721 | A * | 4/1925 | Lasche | F01D 9/02 | 415/119 |
| 1,868,008 | A * | 7/1932 | Gardner | F04D 29/327 | 415/119 |
| 1,983,606 | A * | 12/1934 | Geise | F04D 29/666 | 123/41.49 |
| 2,098,640 | A * | 11/1937 | Cary | F04D 29/666 | 415/119 |

(Continued)

FOREIGN PATENT DOCUMENTS

| | | |
|---|---|---|
| CN | 204783828 U | 11/2015 |
| CN | 103807208 B | 4/2016 |
| TW | M300427 A | 11/2006 |

*Primary Examiner* — Dwayne J White
*Assistant Examiner* — Behnoush Haghighian
(74) *Attorney, Agent, or Firm* — McClure, Qualey & Rodack, LLP

(57) ABSTRACT

A centrifugal fan is disclosed. The centrifugal fan includes a housing; and a fan wheel, disposed in the housing, the fan wheel including: a fan hub; a plurality of inner fan blades, each of the inner fan blades includes a first contact surface and a second contact surface, the first contact surfaces are connected to the fan hub respectively; a plurality of connection structures, each of the connections structure includes a first side and a second side; and a plurality of outer fan blades, each of the outer fan blades includes a first end and a second end; wherein the second contact surfaces are connected to the first sides respectively, the first ends are connected to the second sides respectively.

7 Claims, 6 Drawing Sheets

(56) References Cited

U.S. PATENT DOCUMENTS

| | | | | | |
|---|---|---|---|---|---|
| 3,006,603 | A * | 10/1961 | Caruso | F01D 5/043 | 415/1 |
| 3,285,502 | A * | 11/1966 | Wooden | F04D 29/666 | 415/119 |
| 3,711,219 | A * | 1/1973 | Strick | F04D 29/328 | 416/132 R |
| 4,474,534 | A * | 10/1984 | Thode | F04D 29/328 | 415/119 |
| 5,326,225 | A * | 7/1994 | Gallivan | F04D 29/164 | 416/169 A |
| 5,681,145 | A * | 10/1997 | Neely | F04D 29/328 | 415/119 |
| 6,007,300 | A * | 12/1999 | Saeki | F04D 29/283 | 416/178 |
| 6,644,918 | B2 * | 11/2003 | Masuo | F04D 29/328 | 415/220 |
| 7,029,227 | B2 * | 4/2006 | Berthillier | F01D 5/10 | 415/1 |
| 8,215,918 | B2 * | 7/2012 | Hwang | F04D 29/281 | 416/231 B |
| 8,292,588 | B2 * | 10/2012 | Otsuki | F04D 25/0613 | 415/206 |
| 9,169,844 | B2 * | 10/2015 | Lin | F04D 17/16 | |
| 9,382,919 | B2 | 7/2016 | Cheng et al. | | |
| 9,512,774 | B2 * | 12/2016 | Vaughn | F01P 11/12 | |
| 10,082,305 | B2 * | 9/2018 | Oh | F24F 7/065 | |
| 2008/0101936 | A1 * | 5/2008 | Lee | F04D 29/328 | 416/203 |
| 2013/0292096 | A1 * | 11/2013 | Hung | F04D 29/328 | 165/121 |
| 2018/0320705 | A1 * | 11/2018 | Van Houten | F04D 29/662 | |

* cited by examiner

CENTRIFUGAL FAN

CROSS-REFERENCE TO RELATED APPLICATION

This application claims the priority benefit of CN application serial No. 201621479856.2, filed on Dec. 30, 2016. The entirety of the above-mentioned patent application is hereby incorporated by reference herein and made a part of specification.

BACKGROUND OF THE INVENTION

Field of the Invention

The disclosure relates to a centrifugal fan.

Description of the Related Art

With the development trend of miniaturization of electronic devices, the interior space for heat dissipation of the electronic device is limited. A fan is usually configured in the electronic devices to dissipate heat generated from internal operating components. Since the distance between the fan and the casing of electronic device is reduced, the velocity increasing when the airflow enters the fan so that noise is generated.

BRIEF SUMMARY OF THE INVENTION

A centrifugal fan is disclosed. The centrifugal fan comprises a housing; and a fan wheel, disposed in the housing, the fan wheel including: a fan hub; a plurality of inner fan blades, each of the inner fan blades includes a first contact surface and a second contact surface, the first contact surfaces are connected to the fan hub respectively; a plurality of connection structures, each of the connections structure includes a first side and a second side; and a plurality of outer fan blades, each of the outer fan blades includes a first end and a second end; wherein the second contact surfaces are connected to the first sides respectively, the first ends are connected to the second sides respectively.

DETAILED DESCRIPTION OF THE EMBODIMENTS

Figure 1:
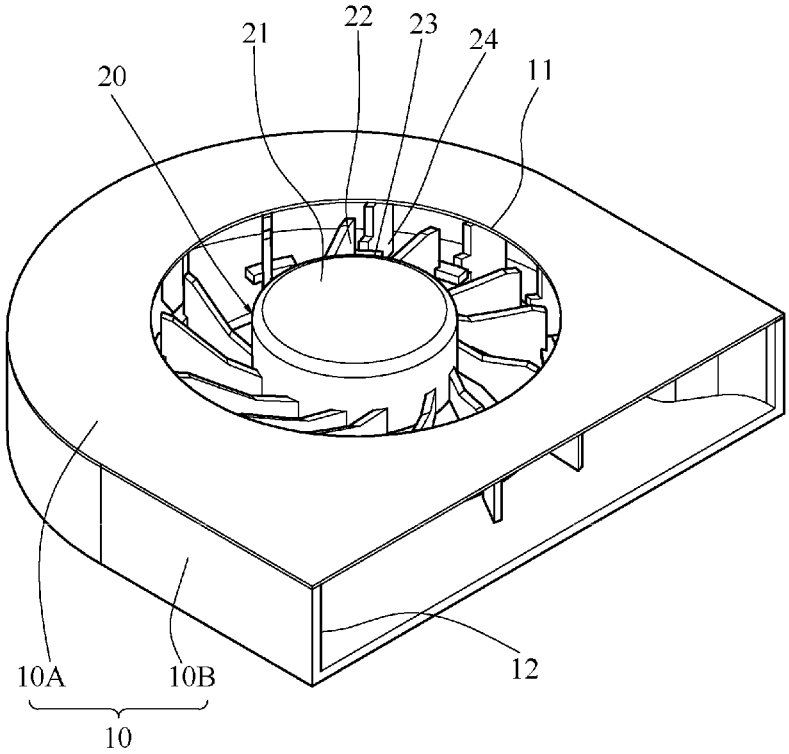
FIG. 1 is a stereoscopic diagram showing a centrifugal fan in an embodiment.
Figure 2:
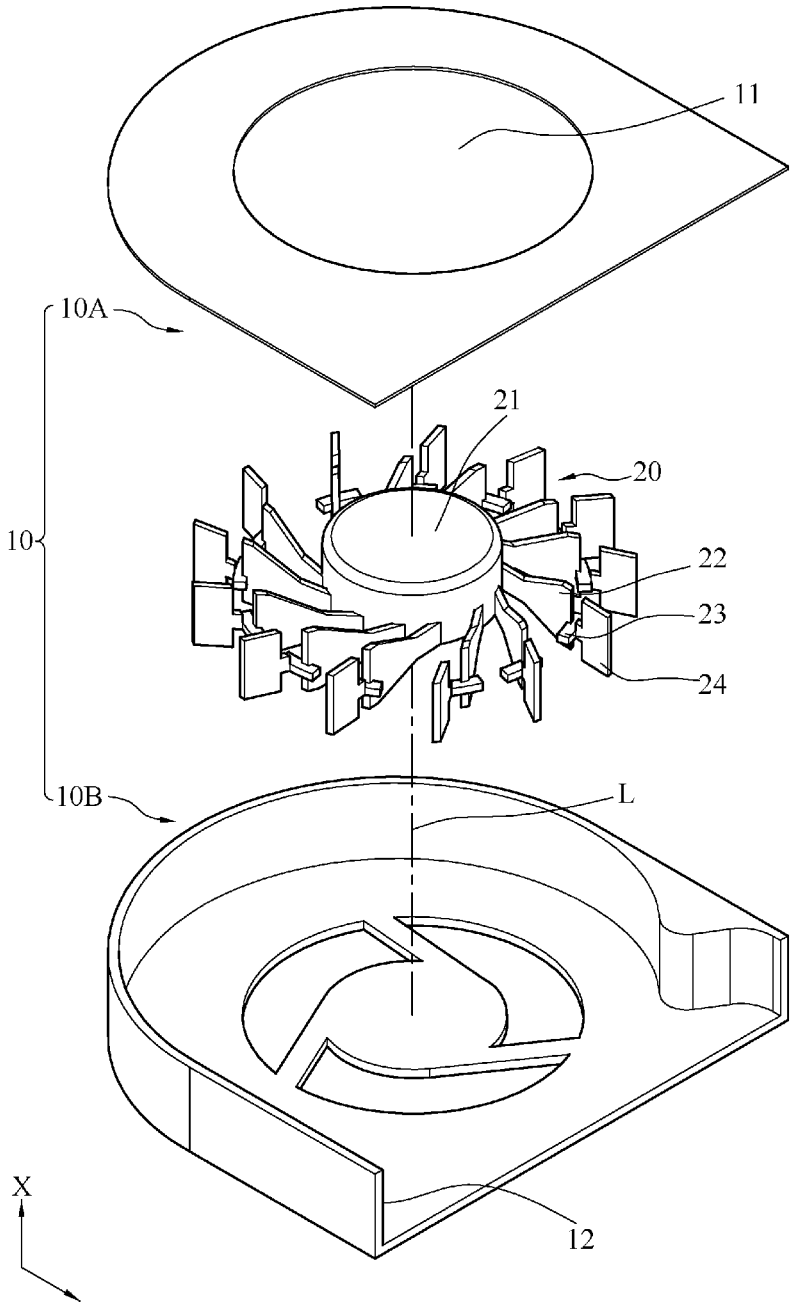
FIG. 2 is an exploded diagram showing a centrifugal fan in an embodiment.

Please refer to FIG. 1 and FIG. 2. FIG. 1 is a stereoscopic diagram showing a centrifugal fan in an embodiment. FIG. 2 is an exploded diagram showing a centrifugal fan in an embodiment. The centrifugal fan shown in FIG. 1 and FIG. 2 includes a housing 10 and a fan wheel 20.

The housing 10 includes an upper cover 10A and a lower cover 10B. The upper cover 10A is a plane structure and includes an air inlet 11. The cover 10B includes a spiral groove. An air outlet 12 is configured at a side of the housing 10. The fan wheel 20 is pivoted in the housing 10 via a fan hub 21 and rotates along a rotation shaft L. Inner fan blades 22 are configured at an outer surface of the fan hub 21. The inner fan blades 22 are adjacent to the air inlet 11 and connected to the outer fan blades 24 via the connection structure 23. When the fan wheel 20 is rotated in the housing 10, the airflow enters into the housing 10 from the air inlet 11. Under the centrifugal force generated by the rotation of the fan wheel 20, the airflow flows out of the air outlet 12 passing through the inner fan blades 22 and the fan outer blades 24 sequentially.

Figure 3:
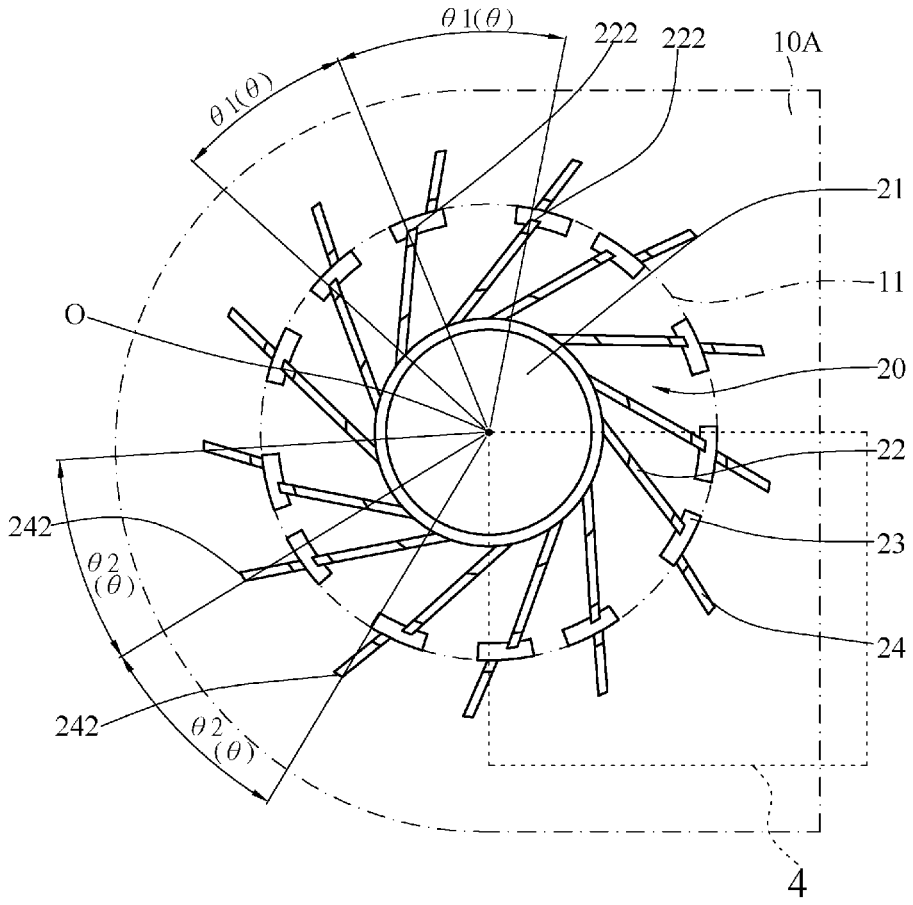
FIG. 3 is a plan schematic diagram showing a centrifugal fan in an embodiment.
Figure 4:
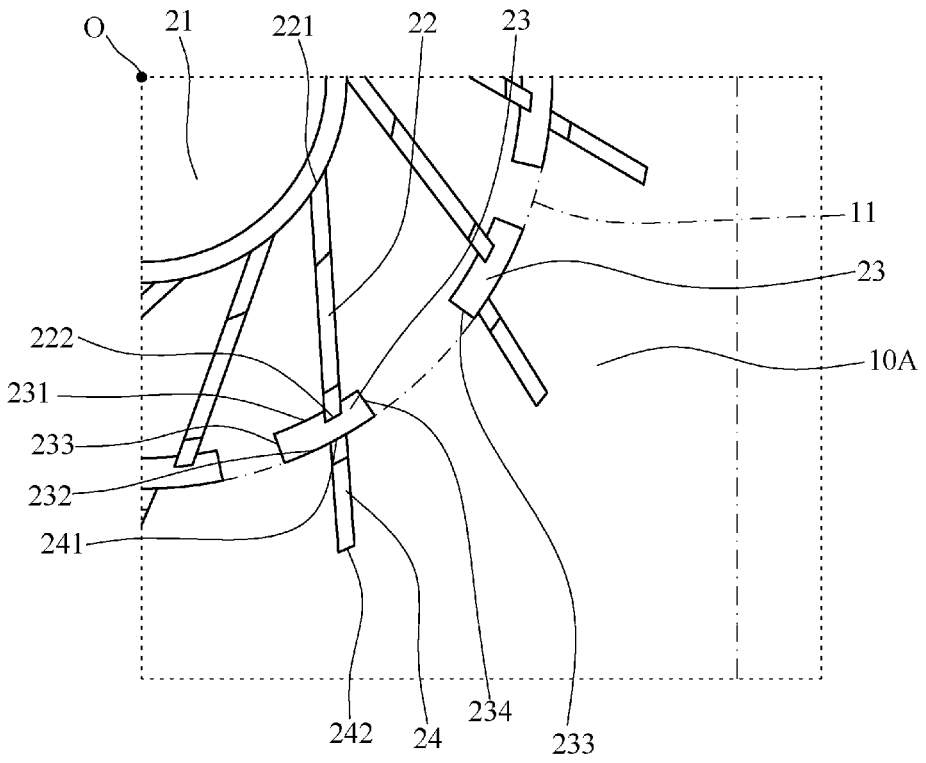
FIG. 4 is a partial enlarged diagram showing the centrifugal fan in FIG. 3.

Please refer to FIG. 3 and FIG. 4. FIG. 3 is a plan schematic diagram showing a centrifugal fan in an embodiment. FIG. 4 is a partial enlarged diagram showing the centrifugal fan in FIG. 3. In the embodiment, the connection structures 23 are not connected with each other. Fan angles θ are formed between adjacent outer fan blades 24 and between adjacent inner fan blades 22 respectively. The fan angles θ are different. That is, the distances between any two of the adjacent outer fan blades 24 are different, and the distances between any two of the adjacent inner fan blades 22 are different. With the arrangement, the airflow contacts with the blades at different time points. As a result, the noise frequency would not be superposed when the airflow contacts the fan blades, and thus the noise is reduced when the fan rotates.

In the embodiment, the inner fan blade 22 includes a first contact surface 221 and a second contact surface 222. The first contact surface 221 of the inner fan blade 22 is connected to an outer surface of the fan hub 21. Compared with the first surface 221, the second contact surface 222 is located far away from the center O of the hub 21. Both the first contact surface 221 and the second contact surface 222 of the inner fan blade 22 are located at the outline scope of the air inlet 11. When the fan wheel 20 rotates, the airflow enters into the fan wheel 20 via the air inlet 11. Under the centrifugal force generated by the rotation of the fan wheel 20, the airflow flows through the inner fan blades 22, the second surfaces 222, and the outer fan blades 24, and then out of the air outlet 12. In the embodiment, the amount of the inner fan blade 22 is an odd number, and thus the inner fan blades 22 of the fan wheels 20 are not symmetrical for preventing the inner fan blades 22 and the fan hub 21 from resonance to improve the stability of the whole system of the centrifugal fan.

The connection structure 23 includes a first side 231, a second side 232, a first edge 233, and a second edge 234. The first side 231 and the second side 232 are disposed opposite to each other. Any position of the first side 231 is closer to the center O of the fan hub 21 than that of the second side 232. The first edge 233 and the second edge 234 are disposed opposite to each other. The first side 231 of the connection structure 23 is connected to the second contact surface 222 of the inner fan blade 22, respectively. Any adjacent connection structures 23 are not connected with each other.

In the embodiment, the connection structure 23 is a curved structure. Any position of the first side 231 has a same radius, and any position of the second side 232 has a same radius. The radius of the second side 232 is larger than the radius of the first side 231. Both the center of curvature of the radius of the first side 231 and that of the second side 232 are located on the rotation shaft L. Therefore, when the fan wheel 20 rotates along the rotation shaft L, the airflow enters the fan wheel 20 and flows around the rotation shaft L. Therefore, the shape of the first side 231 and that of the second side 232 of the connection structure 23 correspond to the flowing path of the airflow. The flowing path of the airflow would not be significantly changed after the airflow contacts with the connection structure 23. Consequently, the interference to the airflow from the connection structure 23 is reduced.

The outer fan blade 24 includes a first end 241 and a second end 242. The first end 241 is connected to the second side 232 of the connection structure 23. Compared with the first end 241, the second end 242 is located far away from the center O of the fan hub 21. The outer fan blade 24 is a planar structure. The curvature of any position between the first end 241 and the second end 242 is zero. In the embodiment, the positions of the first end 241 and the second end 242 of the outer fan blade 24 are located outside the outline scope of the air inlet 11. After the airflow enters the fan wheel 20 in the housing 10 from the air inlet 11, the airflow contacts the inner fan blades 22, and then flows out of the outlet 12 of the housing 10 via the outer fan blades 24. Therefore, the airflow inside and outside of the housing 10 is guided by the inner fan blades 22 and the outer fan blades 24 so that the airflow inside and outside of the housing 10 does not interfere with each other to generate turbulence.

In one embedment, the extending direction of the inner fan blade 22 from the connection point between the second contact surface 222 of the inner fan blade 22 and the first side 231 of the connection structure 23 and the extending direction of the outer fan blade 24 from the connection point between the outer fan blade 24 and the second side 232 of the connection structure 23 are located at same straight line. In one embedment, the extending direction of the inner fan blade 22 from the connection point between the second contact surface 222 of the inner fan blade 22 and the first side 231 of the connection structure 23 and the extending direction of the outer fan blade 24 from the connection point between the outer fan blade 24 and the second side 232 of the connection structure 23 are located at different straight lines.

The fan blade angles θ include a first fan blade angle θ1 between two adjacent inner fan blades 22 and a second fan blade angle θ2 between two adjacent outer fan blades 24. The first fan blade angle θ1 is the angle between the connection lines that the second contact surfaces 222 of two adjacent inner fan blades 22 connected to the center O of the fan hub 21 respectively. The second fan blade angle θ2 is the angle between the connection lines that the second ends 242 of two adjacent outer fan blades 24 connected to the center O of the fan hub 21. In an embodiment, not all first fan blade angles θ1 are the same. In an embodiment, not all second fan blade angles θ2 are the same.

Figure 5:
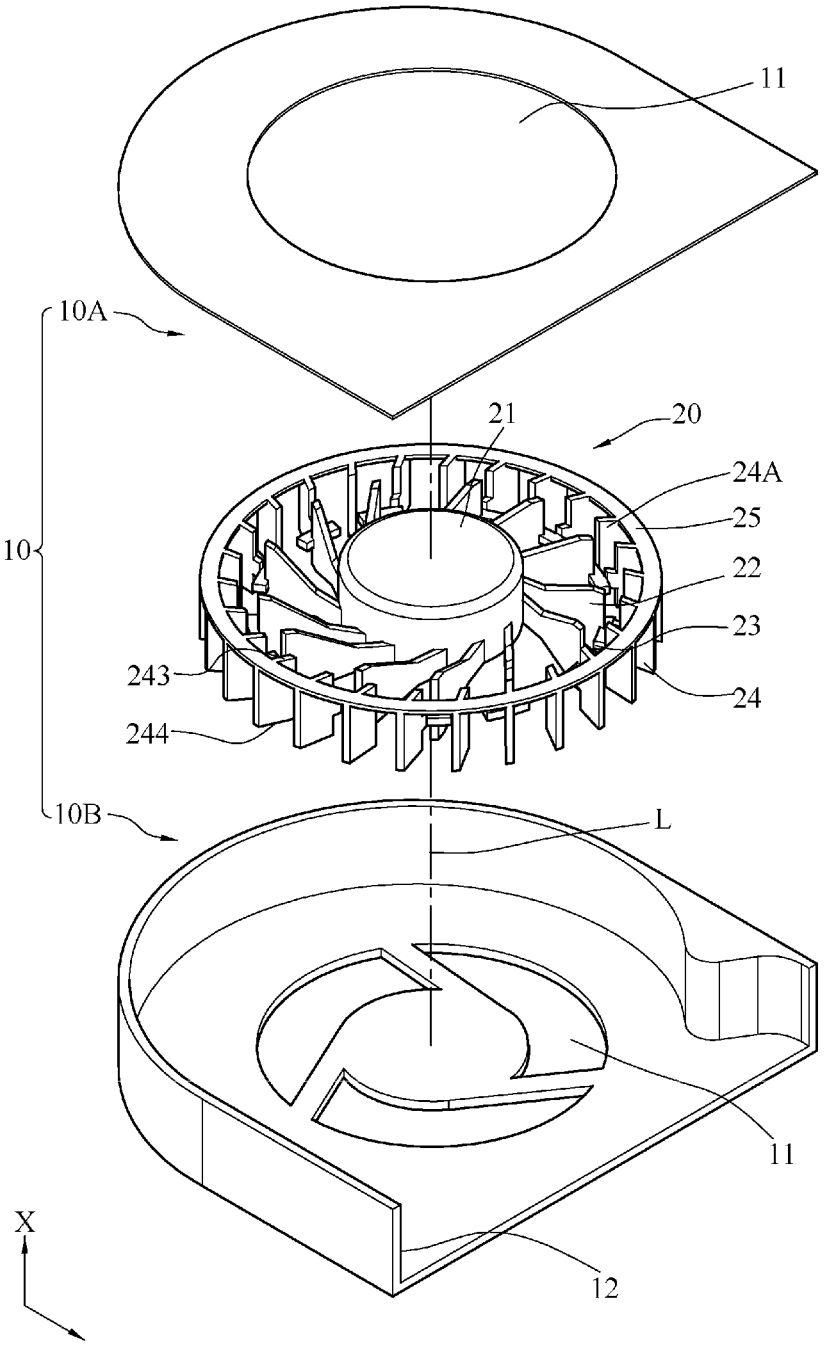
FIG. 5 is an exploded diagram showing a centrifugal fan in an embodiment.
Figure 6:
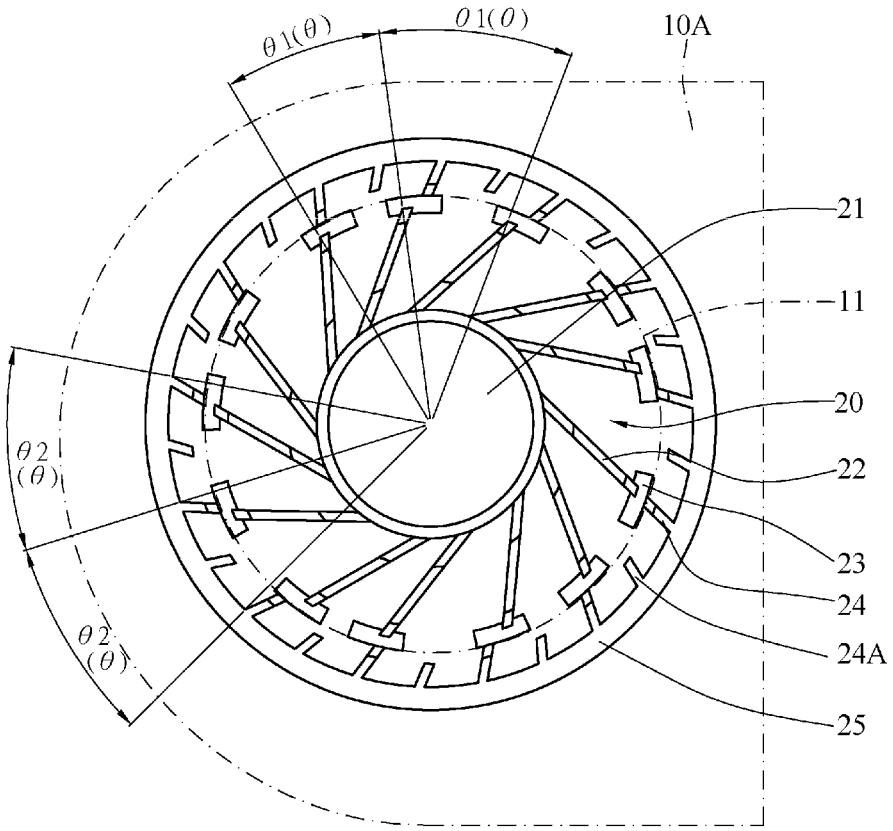
FIG. 6 is a plan schematic diagram showing a centrifugal fan in an embodiment.

Please refer to FIG. 5 and FIG. 6. FIG. 5 is an exploded diagram showing a centrifugal fan in another embodiment. FIG. 6 is a plan schematic diagram showing a centrifugal fan in an embodiment. In the embodiment, the fan wheel 20 further includes a connection ring 25. The connection ring 25 is a circle structure. In an embodiment, the connection ring 25 is connected to the upper side 243 of the outer fan blades 24 close to the upper cover 10A or the lower side 244 close to the lower cover 10B. In an embodiment, the connection ring 25 is both disposed at the upper side 243 and the lower side 244. The center of the connection ring 25 is on the rotation shaft L. The connection ring 25 disposed at the upper sides 243 (or the lower side 244) avoids airflow leakage from the upper side 243 (or the lower side 244) of adjacent outer fan blades 24 before the airflow is guided by the outer fan blade 24.

In the embodiment, secondary outer fan blades 24A are configured at the connection ring 25. The secondary outer fan blades 24A extend from the connection ring 25 to the direction of the fan hub 21. The distance between the secondary outer fan blades 24A and the center O of the fan hub 21 is substantially equal to the distance between the outer fan blades 24 and the center O of the fan hub 21. The secondary outer fan blade 24A and the outer fan blades 24 guide the airflow out via the air outlet 12. In the embodiment, the outer fan blade 24A is provided between every two adjacent outer fan blades 24 for balancing the fan wheel 20.

Although the present invention has been described in considerable detail with reference to certain preferred embodiments thereof, the disclosure is not for limiting the scope. Persons having ordinary skill in the art may make various modifications and changes without departing from the scope. Therefore, the scope of the appended claims should not be limited to the description of the preferred embodiments described above.

What is claimed is:

1. A centrifugal fan, comprising:

a housing, includes an air inlet; and a fan wheel disposed in the housing, including:

a fan hub;

a plurality of inner fan blades, located inside an outline scope of the air inlet, each of the inner fan blades including a first contact surface and a second contact surface, the first contact surfaces connected to the fan hub respectively, distances between every two adjacent inner fan blades of the inner fan blades are different;

a plurality of connection structures, each of the connections structure including a first side and a second side, any adjacent connection structures are not connected with each other; and a plurality of outer fan blades, each of the outer fan blades including a first end and a second end, the positions of the first end and the second end of the outer fan blade are located outside the outline scope of the air inlet;

wherein the second contact surfaces are connected to the first sides respectively, the first ends are connected to the second sides respectively, an extending direction of the one of the inner fan blade away from the fan hub and the extending direction of corresponding one of the outer fan blades away from the connection structure are located at different straight lines.

2. The centrifugal fan according to claim 1, wherein distances between every two adjacent outer fan blades of the outer fan blades are different.

3. The centrifugal fan according to claim 1, wherein an extending direction of each of the inner fan blade away from fan hub and the extending direction of each of the outer fan blades away from the connection structures are located at same straight line.

4. The centrifugal fan according to claim 1, wherein an extending direction of each of the inner fan blade away from fan hub and the extending direction of each of the outer fan blades away from the connection structures are located at not at a same straight line.

5. The centrifugal fan according to claim 1, wherein the centrifugal fan further includes a connection ring, and the connection ring is connected to a side of the outer fan blades.

6. The centrifugal fan according to claim 5, wherein the connection ring further includes a plurality of secondary outer fan blades, and the secondary outer fan blades extend from the connection ring towards the fan hub.

7. The centrifugal fan according to claim 6, wherein each of the secondary outer fan blades are disposed between two adjacent outer fan blades of the outer fan blades, respectively.

* * * * *